United States Patent [19]

Kunita et al.

[11] 4,234,260

[45] Nov. 18, 1980

[54] DEVICE FOR FEEDING INK RIBBON

[75] Inventors: Masao Kunita, Sayama; Nagao Mizutani, Hachiouji; Toshio Kurihara, Tokorozawa, all of Japan

[73] Assignee: Citizen Watch Co., Ltd., Tokyo, Japan

[21] Appl. No.: 973,622

[22] Filed: Dec. 27, 1978

[30] Foreign Application Priority Data

Jan. 24, 1979 [JP] Japan ..... 52/56441

[51] Int. Cl.[3] ..... B41J 33/40

[52] U.S. Cl. ..... 400/219.3; 400/221

[58] Field of Search ..... 400/221, 218, 219.3, 400/219.5, 220.1

[56] References Cited

U.S. PATENT DOCUMENTS

| | | | |
|---|---|---|---|
| 2,487,834 | 11/1949 | Stolz | 400/219.5 |
| 3,786,906 | 1/1974 | Okabe | 400/219.3 |
| 3,825,103 | 7/1974 | Riley | 400/221 X |
| 3,841,459 | 10/1974 | Buschmann et al. | 400/221 X |
| 3,889,795 | 6/1975 | Garberi et al. | 400/221 X |

FOREIGN PATENT DOCUMENTS

| | | | |
|---|---|---|---|
| 2310971 | 9/1974 | Fed. Rep. of Germany | 400/221 |

*Primary Examiner*—Eugene H. Eickholt

*Attorney, Agent, or Firm*—Bernard & Brown

[57] ABSTRACT

A device for feeding an ink ribbon for use in a printing machine in which the ink ribbon is reciprocally run by rotating reels on which the ink ribbon is wound. The device has a main drive member, two driven members, a driving force transmission member, a follower members, a spring and a movement control member and thereby providing a useful and effective device without a nonsensitive zone upon changeover of the running direction of the ink ribbon.

3 Claims, 6 Drawing Figures

DEVICE FOR FEEDING INK RIBBON

BACKGROUND OF THE INVENTION

1. Field of the Invention

The present invention relates to an improved device for feeding an ink ribbon used in a printing machine, and particularly to a mechanism for changing the running direction of the ink ribbon by detecting the end portions of the ink ribbon.

2. Description of the Prior Art

There have so far been proposed several types of mechanisms for changing the running directions of ink ribbons in printers. Among them, representative examples will include a method by which a feeding pawl for effecting reciprocating operation is alternately engaged with the right and left winding wheels on which an ink ribbon is wound after an end portion of the ink ribbon has been detected thereby to change the running direction of the ink ribbon, and a method by which an intermediate gear meshing with a main drive gear which rotates in one direction is alternately engaged with the right and left winding wheels on which the ink ribbon is wound after an end portion of the ink ribbon has been detected in order to change the running direction of the ink ribbon. In order to change the running direction of the ink ribbon by means of either the feeding pawl or the intermediate gear, the abovesaid two methods employed a spring as shown, for example, in U.S. Pat. No. 3,786,906.

With the so-called deviation-producing mechanisms using the spring mentioned above, however, the stable positions are present only at both extreme ends with no stable point at the center. Besides, due to the nature of the changing mechanism, the central portion contains a so-called non-sensitive zone in which the mechanism responds neither to the driving force from the right side nor to the driving force from the left side. Therefore, the conventional mechanisms for changing the running direction of the ink ribbon presented a probability that the changing member (feeding pawl, or intermediate gear) went into halt in the non-sensitive zone. Consequently, according to the conventional mechanisms, the running ink ribbon often came into halt, causing the concentration of the printed characters to be decreased and giving a great damage to the ink ribbon.

Anoter method employed the winding force of the ink ribbon to actuate the changing member. According to this method, however, excess of tensile force was exerted on the ink ribbon when the running direction was to be changed, whereby the printing energy was absorbed in case of the flying-type printing hammers giving rise to the development of non-uniform printing force, deteriorating the quality of printed characters, giving damage to the ink ribbon, and reducing the durability of the ink ribbon.

SUMMARY OF THE INVENTION

In view of the abovementioned respects, the object of the present invention is to provide a device for feeding an ink ribbon which, at the time of changing the running direction of the ink ribbon, enables the changing operation to be reliably carried out without permitting the changing member to come into halt during the changing operation, and which does not exert excessive tensile force on the ink ribbon.

To attain the abovesaid object, the gist of the present invention resides in a device for feeding ink ribbon comprising a main drive member coupled to a drive means and driven by the driving force of said drive means, two driven members for rotating reels on which is wound an ink ribbon, a driving force transmission member which reciprocally moves to selectively transmit the driving force of the main drive member to the two driven members, winding amount follower members which move following the winding amount of the ink ribbon while being contacted with pressure onto the outer peripheral surface of the ink ribbon wound on each of the reels, moving springs for accumulating the moving force for moving the driving force transmission member responsive to the movement of the winding amount follower members, and a movement control member which usually inhibits the movement of the driving force transmission member and which releases the inhibition of movement of the driving force transmission member when an end portion of the ink ribbon is detected.

DETAILED DESCRIPTION OF THE PREFERRED EMBODIMENT

The invention is illustrated below with reference to an embodiment in conjunction with the accompanying drawings.

Figure 1:
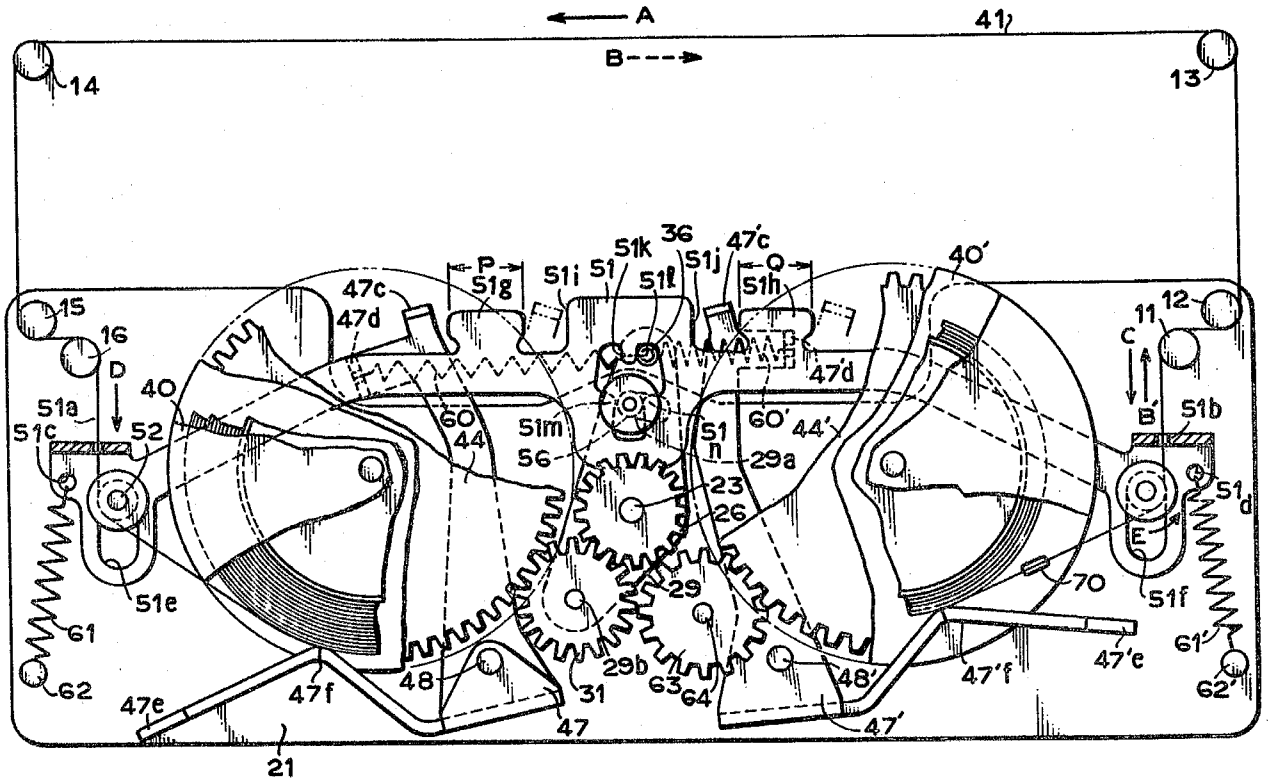
FIG. 1 is a plan view showing a state just before the running direction of the ink ribbon is changed according to an embodiment of the present invention.

Referring to FIG. 1, an ink ribbon 41 is wound from its left end on a reel 40 and from its right end on a reel 40', and is conveyed over guide rollers 11, 12, 13, 14, 15 and 16. The ink ribbon 41 passes close to the front surface of a paper that is to be printed located in front of a type carrier (not shown) on which the front surface are arrayed a group of types. When suitably hit by a flying-type printing hammer, which is not shown, located in front of the ink ribbon, any desired type among the group of types will be printed as a character on the paper that is to be printed. In order that the ink ribbon 41 can be run toward either the right direction or the left direction, an intermediate gear 31 which is a driving force transmission member meshing with a main drive gear 26 that serves as a main drive member, is supported by an intermediate gear moving member 29 and is reversed to come into mesh with any one of two driven gears consisting of a reel gear 44, a reel gear 44' or a rotating direction reversing gear 63, which are driven members. The intermediate gear moving member 29 is controlled by a movement control member 51 which is controlled by follower members 47 and 47' following the winding amount of the ink ribbon, and is allowed to move toward either direction by means of coil springs 60 and 60'. Reference numeral 44' denotes another reel gear corresponding to the reel gear 44.

The intermediate gear 31 and its peripheral construction are mentioned below with reference to FIG. 2.

Figure 2:
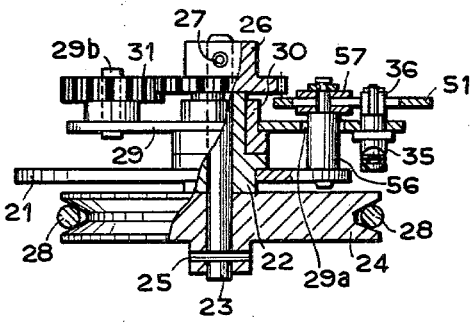
FIG. 2 is a partly cut-away side view to illustrate constituting elements located near the center of FIG. 1.

In FIG. 2, reference numeral 21 denotes a ribbon base plate constituting a portion of the frame of a printing machine. The ribbon base plate 21 is horizontally secured such that elements constituting the ink ribbon-feeding device according to this embodiment can be mounted thereon. Reference numeral 22 denotes a bush of a main drive shaft 23 which is studded nearly at the center of the ribbon base plate 21. The bush 22 has a hole at the center into which a main drive shaft 23 mentioned below can be inserted. The main drive shaft 23 is rotatably supported on the ribbon base plate 21 with being inserted in the hole of the bush 22. The main drive shaft 23 has at its one end the main drive gear 26 which is fastened by means of a fastening screw 27, and has at the other end a main drive pulley 24 with a groove for a belt 28 on its circumference. The main drive pulley 24 is fastened by means of a spring pin 25. Here, a proper clearance in the direction of thrust can be adjusted by moving the fastening position of the main drive gear 26. A motor pulley, not shown, having a groove for the belt 28 on the circumference is also attached to a drive shaft of a prime mover, not shown, that serves as a drive means, and the belt 28 is expanded between the motor pulley and the main drive pulley 24 maintaining such a tension that the driving force can be transmitted. Thus, the main drive gear 26 is rotated in the counterclockwise direction (FIG. 1) by the rotation of the prime mover via the motor pulley, not shown, the belt 28, the main drive pulley 24 and the main drive shaft 23.

Reference numeral 29 represents an intermediate gear moving member having a bush 30 at the central portion. The intermediate gear moving member 29 is rotatably supported by the main drive shaft bush 22 via the bush 30, and has at its one end an intermediate gear shaft 29*b* that serves as a center of rotation for the intermediate gear 31, and further has at its other end a trigger pin 35. At a middle point between the bush 30 and the trigger pin 35 is formed an elongated stop hole 29*a* through which will penetrate a shabt 56 for receiving the movement control member 51. Briefly speaking, the intermediate gear 31 is rotatably supported by the intermediate gear shaft 29*b* and is always in mesh with the main drive gear 26 so as to be rotated in the clockwise direction (FIG. 1). By reversing the movement of the intermediate gear moving member 29, the rotating force of the main drive gear 26 can be transmitted to the reel gear 44 or to the rotating direction reversing gear 63.

Figure 3:
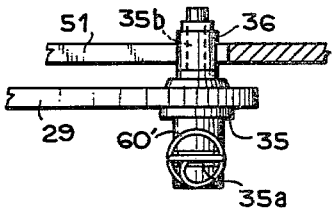
FIG. 3 is a side view for illustrating constituting elements near the tip of an intermediate gear moving member.

Construction of the trigger pin 35 is illustrated below with reference to FIG. 3. The trigger pin 35 is attached at its central portion to the intermediate gear moving member 29, and has at its one end a spring-hooking portion 35*a* to which will be hooked the springs 60 and 60', and further has at the other end a trigger roller shaft 35*b* for rotatably supporting a trigger roller 36. Referring to FIG. 1 again, reference numerals 40 and 40' designate reels for winding the ink ribbon 41. Construction for supporting or rotating the reel is common for both reels 40 and 40'. Therefore, construction for supporting and rotating the reel 40 is mentioned below with reference to FIG. 4, and construction for the other reel 40' is omitted here.

Figure 4:
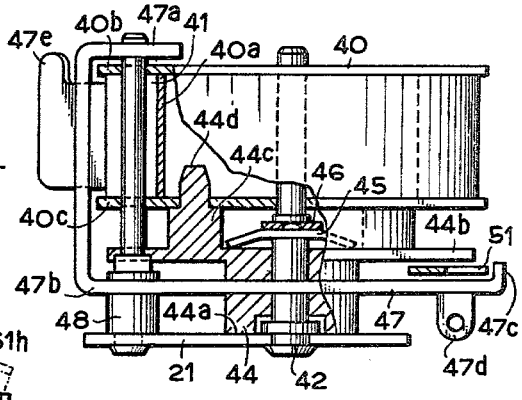
FIG. 4 is a partly cut-away side view illustrating a reel and constituting elements around the reel.

In FIG. 4, reference numeral 42 denotes a reel shaft studded on the ribbon base plate 21, which serves as a rotating shaft for the reel 40 and a reel gear 44. Illustrating the reel 40 in further detail, it has at a central portion a center hole in which will be inserted the reel shaft 42 that serves as a rotating shaft, and a rotating force transmission hole for transmitting the rotating force. The reel 40 further has on the outer circumference a drum 40*a* on which will be wound the ink ribbon 41, an ink ribbon stop portion, not shown, formed on the drum 40*a* for fastening an end of the ink ribbon 41, and flanges 40*b* and 40*c* located at two places to help the wind of the ink ribbon 41. The reel 40 is detachably and rotatably fitted to the reel shaft 42. Reference numeral 44 designates a reel gear for rotating the reel 40, having at its central portion a center hole which rotatably fits to the reel shaft 42, and a contact surface 44*a* that comes into contact with the ribbon base plate 21. The reel gear 44 further has on its outer circumference a gear unit 44*b* that meshes with the intermediate gear 31, a reel-receiving portion 44*c* for receiving the reel 40, and a projection 44*d* fitted to the rotating force transmission hole of the reel 40 to transmit the rotating force to the reel 40. The reel gear 44 is rotatably supported with the reel shaft 42 as a center. Although it pertains to the prior art, an eyelet 70 (another eyelet not shown) having a sufficient thickness as compared with the thickness of the ink ribbon 41 is fastened to both end portions of the ink ribbon 41 (FIG. 1). The two end portions of the ink ribbon have stop portions, not shown, fastened by an ink ribbon stop, which is not shown, of the reel 40, such that the ink ribbon 41 is anchored to the reel 40 by means of the stop portions. Reference numeral 45 represents a leaf spring which cases the contact surface 44*a* of the reel gear 44 to come into pressed contact with the ribbon base plate 21, so that the reel 40 following the movement of the ink ribbon 41 will not be excessively rotated by the inertial force or disturbance. Owing to the abovesaid contact under the application of pressure, there is produced a frictional force which works to control the rotation of the reel gear 44. The reel spring 45 has at its central portion a center hole in which will be inserted the reel shaft 42, and outer portions of the reel spring 45 are brought into contact with the reel gear 44. The leaf spring 45 is compressed by an E-shaped retaining ring 46 fitted to the reel shaft 42 and the reel gear 44, such that a compressive force is exerted on the reel gear 44.

The shape of the follower member 47 is symmetrical to the shape of the follower member 47'. The supporting construction and functions of these two follower members 47, 47' are the same. Therefore, the follower member 47 and its peripheral construction are illustrated below with reference to FIG. 4, and the other follower member 47' and its peripheral construction are not mentioned.

In FIG. 4, reference numeral 48 denotes a shaft which is studded on the ribbon base plate 21 and which serves as a swinging shaft for the follower member 47. The follower member 47 is roughly of an L-shape (FIG. 1) and is formed in a U-shape at the central portion, and is swingably supported by the shaft 48 penetrating through two side pieces 47*a* and 47*b*. The follower member 47 has at its one end an operation portion 47*e* by which it can be manually operated when the reel 40 is to be attached or detached, and an ink ribbon contact portion 47*b* (FIG. 1) which is smoothly curved so as to come into contact with the ink ribbon 41 wound on the reel 40, maintaining a width slightly narrower than the distance between the flanges 40*b* and 40*c* of the reel 40.

Here, the follower member 47 pushes the ink ribbon 41 wound on the reel 40 being urged by the spring 60 that will be mentioned later. Owing to the frictional force produced by the pressing force of the follower member 47, the rotation of the reel 40 is controlled via the ink ribbon 41. Here, the follower member 47 is caused to move responsive to the winding amount of the ink ribbon 41, whereby the force for moving the intermediate gear moving member 29 is gradually accumulated in the spring 60, and further the reel 40 is prevented from disengaged from the reel shaft 42. On the other end of the follower member 47 are provided a stop portion 47*c* for stopping the movement of the movement control member 51, and a spring stop portion 47*d* to which will be hooked the spring 60.

With reference to FIG. 1 again, reference numeral 51 denotes a movement control member slidably supported by means of shafts 52, 52', for supporting the movement control member and the shaft 56. The movement control member 51 is symmetrical in shape, and has, at the center, ribbon grooves 51*a* and 51*b* which permit the ink ribbon 41 to pass through. The movement control member 51 further provided with elongated holes 51*e* and 51*f* in which will be inserted shafts 52 and 52' as well as spring-hooking holes 51*c* and 51*d* to which will be hooked movement control member springs 61 and 61' adjacent to the elongated holes 51*e* and 51*f*. Further, at the central portion of the movement control member 51 are formed swing-inhibiting portions 51*g* and 51*h* that come into contact with the movement control member stop portions 47*c* and 47'*c* which are means for stopping the movement control member, the stop portions 47*c* and 47'*c* being formed on the portions of the follower members 47 and 47', in order to inhibit the swinging motion of the movement control member 51 except the moment of changing the running direction of the ink ribbon 41. At the central portion of the movement control member 51 are further formed stop portions 51*i* and 51*j* to which will come into contact the movement control member stop portions 47*c* and 47'*c* of the follower members 47 and 47', in order that the swinging amounts of the follower members 47 and 47' are controlled and are not derailed by the excess or lack of the force of the spring 60 and 60' when the reels 40, 40' are not loaded, or when the winding amount of the ink ribbon wound about the drums 40*a*, 40'*a* of the reels 40, 40' are small. Moreover, at the central portion of the movement control member 51 are formed in control portions 51*k* and 51*l* shaped in protrusion, which work to stop the trigger roller 36 in order to inhibit the rotation of the intermediate gear moving member 29, as well as portions 51*m* and 51*n* supported by washers 57 and 57' (FIG. 5) fitted to the shaft 56 that will be mentioned later.

Construction for supporting the movement control member 51 is illustrated below with reference to FIG. 5.

Figure 5:
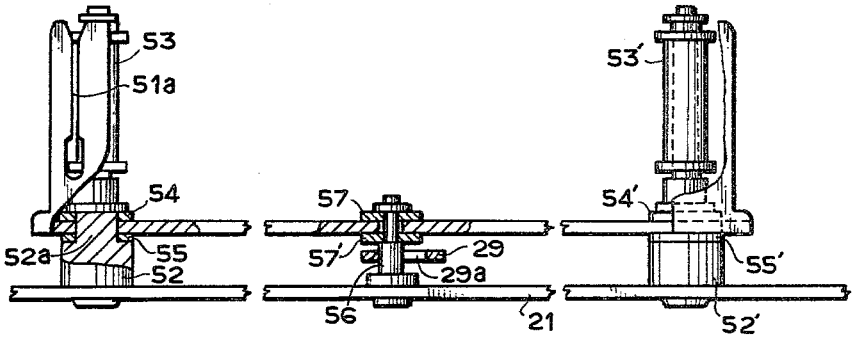
FIG. 5 is a side view to illustrate the construction for supporting a movement control member.

Referring to FIG. 5, the shafts 52 and 52' are studded on the ribbon base plate 21, and have at the central portions movement control member support portions 52*a* (movement control member support portion on the other side is not shown) that serve as swinging centers for the movement control member 51 and that slidably support the movement control member 51 in cooperation with support shaft washers 54, 55, 54' and 55'. The shafts 52 and 52' further have at their tips guide roller shafts, not shown, to rotatably support the ribbon guide rollers 53 and 53'. The shaft 56 is studded on a central portion of the ribbon base plate 21, supports the portions 51*m* and 51*n* of the movement control member 51 via two pieces of washers 57 and 57', and penetrates through the elongated stop hole 29*a* formed in the intermediate gear moving member 29 thereby to restrict the rotating amount of the intermediate gear moving member 29. Here, the movement control member 51 has many slide surfaces as mentioned in the foregoing. Therefore, if the support shaft washers 54, 55, 54', 55' and receiving shaft washers 57, 57' supporting the movement control member 51, are made of a synthetic resin material having lubricating property such as polyacetal resin or polytetrafluoroethylene the movement control member 51 can be stably and smoothly moved.

Illustrating the construction for supporting the movement control member 51 in other way, the movement control member 51 is allowed to swing with one shaft 52 as a center and with the another shaft 52' as another center, while being supported by the shafts 52 and 52' and by the shaft 56.

Referring to FIG. 1 again, the springs 60 and 60' have the same shape, and their ends on one side are hooked to the spring-hooking portion 35*a* of the trigger pin 35 (refer to FIG. 3), and their other ends are hooked to the spring-hooking portions 47*d* and 47'*d* of the follower members 47 and 47', whereby the follower member 47 is urged to turn clockwise while the follower member 47' is urged to turn counterclockwise. The springs 60, 60' are strained as the follower members 47 and 47' are moved depending upon the winding amount of the ink ribbon 41, and gradually accumulate the force for moving the intermediate gear moving member 29. The springs 61 and 61' always urge the movement control member 51 toward the directions C and D so as to maintain the state shown in FIG. 1, except the moment of changing the running direction of the ink ribbon 41, and are expanded between the spring-hooking portions 51*c*, 51*d* of the movement control member 51 and spring-hooking rods 62, 62' studded to the ribbon base plate 21. The rotating direction reversing gear 63 works to rotate the reel gear 44' in the same direction as that of the intermediate gear 31 which rotates in the clockwise direction, and is always in mesh with the reel gear 44'. The rotating direction reversing gear 63 is so located as to come into mesh with the intermediate gear 31, and is rotatably supported by a gear shaft 64 studded on the ribbon base plate 21 for the rotating direction reversing gear 63. The rotating direction reversing gear 63 may further be rotatably supported by the intermediate gear moving member 29 at a position where it is always in mesh with the intermediate gear 31 so as to rotate together with the intermediate gear 31. The rotating direction reversing gear 63 is not necessary when the two reel gears 44 and 44' are to be rotated in the samde direction, and in this case, the reel gears 44 and 44' work as follower members.

Below are mentioned interrelationships among the intermediate gear moving member 29, the follower members 47, 47', and the movement control member 51 employed for the abovementioned construction.

As mentioned above, the intermediate gear moving member 29 must rotate not only the intermediate gear 31 but also must hold the intermediate gear 31 at a position where the intermediate gear 31 comes into proper mesh with either one of the reel gear 44 or the rotating direction reversing gear 63. Below is mentioned with reference to FIG. 1 a construction in which the intermediate gear moving member 29 on which is mounted the intermediate gear 31 is held at a proper position. FIG. 1 shows the state in which the intermediate gear moving member 29 is rotated in the clockwise direction. In this state, the rotation of the intermediate gear moving member 29 in the clockwise direction is interrupted by the engagement of the elongated stop hole 29*a* with the movement control member receiving shaft 56, and the rotation in the counterclockwise direction is prevented by the engagement of the trigger roller 36 with the control portion 51*l* of the movement control member 51, whereby the intermediate gear moving member 29 is held at the position. Where the intermediate gear 31 and the reel gear 44 are engaged with each other. Even when the intermediate gear moving member 29 is rotated in the counterclockwise direction, causing the intermediate gear 31 to engage with the rotating direction reversing gear 63, the rotation of the intermediate gear moving member 29 is interrupted by the elongated stop hole 29*a*, movement control member receiving shaft 56, trigger roller 36, and control portion 51*k* of the movement control member 51, whereby the intermediate gear moving member 29 maintains the position where are engaged the intermediate gear 31 and the rotating direction reversing gear 63. Thus, according to the embodiment of the present invention, the mechanism works to maintain at a predetermined position the intermediate gear moving member 29 having the intermediate gear 31, without relying upon the conventional deviation-producing mechanism which employs a reversing spring and which results in the occurrence of non-sensitive zones. Accordingly, the mechanism for changing the running direction of the ink ribbon 41 does not present unstable region when the running direction of the ink ribbon 41 is to be changed and does not cause the intermediate gear moving member 29 to stop at intermediate positions. Therefore, the running ink ribbon 41 is not halted even when the running direction of the ink ribbon 41 is to be changed, thereby enabling the running direction of the ink ribbon to be reliably changed.

Figure 6:
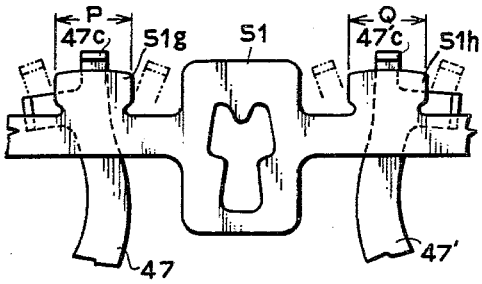
FIG. 6 is a plan view to illustrate a relationship between a winding amount follower member and the movement control member.

As mentioned above, the movement control member 51 is maintained by the springs 61 and 61' in a state shown in FIG. 1 to hold the intermediate gear moving member 29 in position. However, the trigger roller 36 may be disengaged if a swinging force is exerted on the movement control member 51 caused by an operator of the printing machine or by a great impact from an external source. If the engagement of the trigger roller 36 is abruptly released, the following inconvenience in operation may arise. That is, when the ink ribbon 41 is wound nearly in equal amounts on the reel 40 and on the reel 40', the resilient forces of the springs 60 and 60' hooked to the follower members 47 and 47' are nearly equal, whereby the force for rotating the intermediate gear moving member 29 is weak. Under such a state, if the engagement of the trigger roller 36 is released, the intermediate gear 31 come into mesh with neither the reel gear 44 nor the rotating direction reversing gear 63, and the rotating force to the main drive gear 26 is interrupted, causing the ink ribbon 41 to come into halt. Construction to cope with this undesirable event is illustrated below with reference to FIG. 6. When the ink ribbon 41 is nearly equally wound on both reels as shown in FIG. 6, the movement control member stop portions 47*c* and 47'*c* of the follower members 47 and 47' are located within inhibition zones P and Q determined by swing-inhibition portions 51*g* and 51*h* of the movement control member 51. Therefore, the swinging motion of the movement control member 51 is inhibited to prevent any undesirable movement. Further, as most of the ink ribbon 41 is wound on either one of the reel 40 or the reel 40', and as the force for rotating the intermediate gear moving member 29 is sufficiently accumulated in the spring 60 or 60', the movement control member stop portions 47*c* and 47'*c* are caused to be located outside the inhibition zones P and Q defined by the swing-inhibition portions 51*g* and 51*h*, whereby the movement control member 51 is liberated from its locked state.

Below are mentioned functions of the abovesaid construction with reference to the drawings.

Referring to FIG. 1, as a prime mover which is not shown is rotated responsive to the starting command, the type conveyor which is not shown and the printing mechanism which is not shown are operated to effect the printing at any moment. Accompanying the rotation of the prime mover, the main drive gear 26 rotates counterclockwise, the intermediate gear 31 in mesh with the main drive gear 26 rotates clockwise, the reel 40 coupled to the reel gear 44 in mesh with the intermediate gear 31 rotates counterclockwise, and the ink ribbon 41 runs in a direction A while it is wound on the reel 40. As the ink ribbon 41 wound on the reel 40, the follower member 47 which is in pressed contact with the outer circumference of the ink ribbon 41 is rotated in the counterclockwise direction in proportion to the increase of the outer diameter of the ink ribbon wound on the reel 40, and the spring 60 stretching between the follower member 47 and the intermediate gear moving member 29 is expanded. The follower member 47' also rotates in the counterclockwise direction as the outer diameter of the ink ribbon 41 would on the reel 40' is reduced, so that the spring 60' is stretched between the follower member 47' and the intermediate gear moving member 29 is loosened. Therefore, the intermediate gear moving member 29 is urged to turn counterclockwise due to the difference between the resilient force of the spring 60 and the resilient force of the spring 60', but is not rotated because it engages with the stop portion 51*l* of the movement control member 51. As the amount of the ink ribbon 41 wound on the reel 40 reaches a predetermined thickness as shown in FIG. 1, the movement control member 51 is liberated from its locked state above. As the ink ribbon 41 is further wound, the eyelet 70 attached to the other end portion of the ink ribbon 41 moves toward a direction E and comes into contact with the ribbon groove 51*b* of the movement control member 51 and causes the movement control member 51 to swing toward a direction B' with the shaft 52 as a center. Then, the trigger roller 36 is disengaged from the stop portion 51*l* of the movement control member 51, and the intermediate gear moving member 29 is caused to turn counterclockwise owing to the rotating force created by the difference between the resilient force of the spring 60 and the resilient force of the spring 60', until the elongated stop hole 29*a* comes into contact with the shaft 56. Owing to the rotation of the intermediate gear moving member 29 in the counterclockwise direction, the intermediate gear 31 disengages from the reel gear 44 and comes into engagement with the rotating direction reversing gear 63, whereby the predetermined position is maintained by the residual rotating force created by the difference between the resilient force remaining in the spring 60 and the resilient force of the spring 60'. Consequently, the rotating force of the main drive gear 26 is transmitted to the reel 40', so that the ink ribbon 41 runs toward a direction B, the eyelet 70 retracts, and the movement control member 51 swings toward a direction C due to the resilient force of the movement control member spring 61', thereby to restore the state shown in FIG. 1. Accordingly, the trigger roller 36 mounted on the intermediate gear moving member 29 is stopped by the stop portion 51*k* of the movement control member 51, and the intermediate gear 31 is kept engaged with the rotating direction reversing gear 63. Thus, the abovementioned engaged state is reliably maintained even after the residual rotating force which caused the intermediate gear 31 to be in mesh with the rotating direction reversing gear 63 is extinguished due to the relaxation of the spring 60 as a result of the movement of the ink ribbon 41 toward the direction B.

In the abovesaid operation for changing the running directions of the ink ribbon, the intermediate gear moving member 29 is rotated by the resilient force of the spring 60 which gradually accumulates the force accompanying the winding operation of the ink ribbon. Therefore, as compared with the system which changes the running direction utilizing the force of winding the ink ribbon only during the moment of changing the running direction, the system of the present invention does not exert excessive tensile force on the ink ribbon 41, so that the ink ribbon 41 is less damaged and the quality of printed characters is less deteriorated.

The running direction toward the opposite direction can also be changed in the same manner as the abovementioned operation for changing the running direction of the ink ribbon. That is, as the ink ribbon 41 runs toward the direction B and is wound on the reel 40', the follower members 47 and 47' swing in the clockwise direction depending upon the wound amount of the ink ribbon 41. Then, as the movement control member 51 is swung by the eyelet, not shown, attached to an end portion of the ink ribbon 41 with the shaft 52' of the movement control member 51 as a center, the intermediate gear 31 is caused to be reversed to come into mesh with the reel gear 44. The ink ribbon 41 is then caused to run toward the direction A. Owing to such alternate change in running directions, the ink ribbon 41 is allowed to run in a reciprocating manner.

According to the aforementioned embodiment of the present invention, the rotating force of the main drive gear which rotates in one direction is selectively transmitted via intermediate gear to two driven gears for rotating the reels, such that the ink ribbon can be run in both directions. Further, the running direction of the ink ribbon is changed by moving the intermediate gear utilzing a resilient force gradually accumulated in the spring, and the movement of the intermediate gear is controlled by the movement control member.

According to another embodiment of the present invention, a driving force of the main drive member which reciprocally moves is selectively transmitted to two ratchet wheels for rotating the reels by means of a driving power transmission member, so that the ink ribbon can be run in both directions, and the running direction of the ink ribbon is changed by moving the driving force transmission member utilizing the resilient force gradually accumulated in the spring, and the movement of the driving power transmission member is controlled by the movement control member.

As will be obvious from the foregoing description, according to the pesent invention, the driving force transmission member is maintained at a proper position by means of the aforementioned mechanism without relying upon the conventional deviation-producing mechanism based on a reversing spring having non-sensitive zones. As shown in U.S. Pat. No. 3,786,906, the conventional deviation mechanism using a pawls feeding a ribbon reel by a spring generates a so-called no-sensitive zone where the mechanism does not serve as a precise changeover mechanism when the running direction of an ink ribbon is about to be changed. Therefore, the mechanism for changing the running direction of the ink ribbon of the present invention is free of the unstable region, and enables the running direction of the ink ribbon to be reliably changed, permitting the ink ribbon to run stably. Further, since the force for changing the running direction of the ink ribbon is gradually accumulated accompanying the winding of ink ribbon, excessive tension is not exerted on the ink ribbon at the time of changing the running direction, and hence no damage is given to the ink ribbon and the quality of the printed characters is not deteriorated. Moreover, the spring which gradually accumulates the changing force so works as to prevent the ink ribbon from loosened even when the reel is rotated unnecessarily, and a member pushed by the moving spring prevents the reel from removed, thereby facilitating the operation for attaching and detaching the reel.

What is claimed is:

1. A device for feeding an ink ribbon for use in a printing machine in which said ink ribbon is reciprocally run by rotating reels on which said ink ribbon is wound, said device for feeding said ink ribbon comprising:

a. a main drive member, a drive means coupled to the main drive member for providing driving force thereto;

b. two driven members for rotating said reels on which is wound said ink ribbon;

c. a driving force transmission member which reciprocally moves to selectively transmit the driving force of said main drive member to said two driven members;

d. follower members which move following the winding amount of said ink ribbon while being contacted with pressure onto the outer peripheral surfaces of said ink ribbon wound on each of said reels;

e. a spring for accumulating a force by the movement of said follower members, the accumulated force being used for moving said driving force transmission member; and f. a movement control member which usually inhibits the movement of said driving force transmission member and which releases the inhibition of movement for said driving force transmission member when an end portion of the ink ribbon is detected.

2. A device for feeding an ink ribbon according to claim 1, wherein each of said follower members is equipped with a movement control member stop means in order to prevent unnecessary movement of said movement control member.

3. A device for feeding an ink ribbon for use in a printing machine in which said ink ribbon is reciprocally run by rotating reels on which said ink ribbon is wound, said device for feeding said ink ribbon comprising:

a. a ribbon base plate being a portion of a frame in said device;

b. a main drive gear provided on said ribbon base plate;

c. an intermediate gear engaged with said main drive gear;

d. a reel gear engaged with said intermediate gear and associated with one of said reels;

e. a follower member detecting the winding amount of said ink ribbon wound on said reel;

f. an intermediate gear moving member supporting said intermediate gear;

g. a spring accumulating an energy caused by a following movement of said follower member and driving said intermediate gear moving member by said energy;

h. a movement control member pivotably provided on said ribbon base plate through said intermediate gear moving member and controlled by said follower member, and each end of said movement control member connected with said ribbon base plate by a tension spring and having a hole through which said ink ribbon reciprocally passes; and i. said ink ribbon having a projection near both ends thereof for engaging said hole of said movement control member.

* * * * *